United States Patent [19]

Jones et al.

[11] 4,057,251

[45] Nov. 8, 1977

[54] DART GAME WITH APERTURED TARGET PLATES RESILIENTLY MOUNTED

[75] Inventors: Richard F. Jones, Rockford; Ernest L. Ping, Loves Park, both of Ill.

[73] Assignee: Arachnid, Incorporated, Rockford, Ill.

[21] Appl. No.: 685,093

[22] Filed: May 10, 1976

[51] Int. Cl.[2] ..... A63B 65/02; A63B 67/00; A63B 63/00

[52] U.S. Cl. ..... 273/95 R; 273/102 B; 273/DIG. 1; 273/102.2 R

[58] Field of Search ..... 273/102 B, 106.5 R, 273/106.5 B, 102.2 R, 102.2 S, 95 R

[56] References Cited

U.S. PATENT DOCUMENTS

| | | | |
|---|---|---|---|
| 1,199,564 | 9/1916 | Judge | 273/102 B |
| 2,808,266 | 10/1957 | Rose | 273/102 B |
| 2,818,259 | 12/1957 | Arenson | 273/102 B |
| 3,309,091 | 3/1967 | Haecker | 273/102 B |

FOREIGN PATENT DOCUMENTS

| | | | |
|---|---|---|---|
| 474,718 | 1/1915 | France | 273/102.2 R |
| 1,334,767 | 7/1963 | France | 273/102 R |
| 271,262 | 2/1930 | Italy | 273/102.2 R |
| 520,021 | 4/1940 | United Kingdom | 273/102 B |

*Primary Examiner*—Richard C. Pinkham
*Assistant Examiner*—Lawrence E. Anderson
*Attorney, Agent, or Firm*—Leydig, Voit, Osann, Mayer & Holt, Ltd.

[57] ABSTRACT

A dart includes a flexible plastic tip having a comparatively blunt point and is adapted to be thrown at a dart board having an array of target plates formed with holes for receiving and holding the tip. Each target plate shifts inwardly upon being struck by a dart and effects closing of a switch for producing a scoring signal.

10 Claims, 10 Drawing Figures

DART GAME WITH APERTURED TARGET PLATES RESILIENTLY MOUNTED

BACKGROUND OF THE INVENTION

This invention relates generally to a dart game and more particularly to a dart game having "safe"darts and having a dart board or target which automatically indicates the score attained by the player or players. Various types of safe darts (i.e., darts which are not likely to cause personal injury) are disclosed in Morrison, Jr. U.S. Pat. No. 1,075,264; Tyllyer U.S. Pat. No. 2,118,368; Brenkert et al U.S. Pat. No. 3,454,276 and Melvin U.S. Pat. No. 3,455,553. The latter three patents also disclose automatic score indicators as do Ullman U.S. Pat. Ser. No. 346,876; Kimmel et al U.S. Pat. No. 2,592,429; Gaut U.S. Pat. No. 2,629,599 and Callaway U.S. Pat. No. 3,790,173.

SUMMARY OF THE INVENTION

One of the important objects of the present invention is to provide a new and improved dart game having unique safe darts which closely resemble conventional metal tipped darts in appearance, flight characteristics and target-striking characteristics but which are virtually incapable of piercing a person's skin or causing damage to walls or other surroundings adjacent the dart board.

In large, the foregoing is achieved by providing a dart which is identical to a standard metal tipped dart except that the new dart includes a slender tip made of flexible plastic and formed with a comparatively blunt point. Upon striking a solid object, the flexible tip deflects laterally while the blunt point prevents the tip from penetrating the object. The dart thus bounces harmlessly away from the object rather than causing injury or damage.

To enable the above-described dart to "stick" in a target, the invention contemplates the provision of a novel dart board having an array of target plates molded with a large number of closely spaced holes corresponding substantially in size to that of the tip. When the dart is thrown at the board, the tip almost invariably enters into one of the holes and then remains in that hole until removed by the player. One of the features of the invention resides in the unique construction of the target plates to enable the tip to find its way into one of the holes even though the tip might initially strike the plate in an area between adjacent holes. Also, the target plates are divided into different scoring areas by a spider which is constructed in a novel manner to guide the dart to one of the target plates when the dart initially strikes the spider.

Another important aim of the invention is to utilize the target plates to advantage to enable automatic signaling of the score attained when the dart strikes the board. For this purpose, the target plates are slidably supported and, when a given target plate is struck by a dart, the plate slides inwardly to effect closure of electrical switch contacts which, upon closing, direct a signal to a scoring register. This aspect of the invention is particularly characterized by the comparatively simple construction of the switch contacts and by the novel manner in which the target plates are guided in order to insure closure of the switch contacts each time a dart strikes one of the plates.

These and other objects and advantages of the invention will become more apparent from the following detailed description when taken in conjunction with the accompanying drawings.

DETAILED DESCRIPTION OF THE PREFERRED EMBODIMENTS

Figure 1:
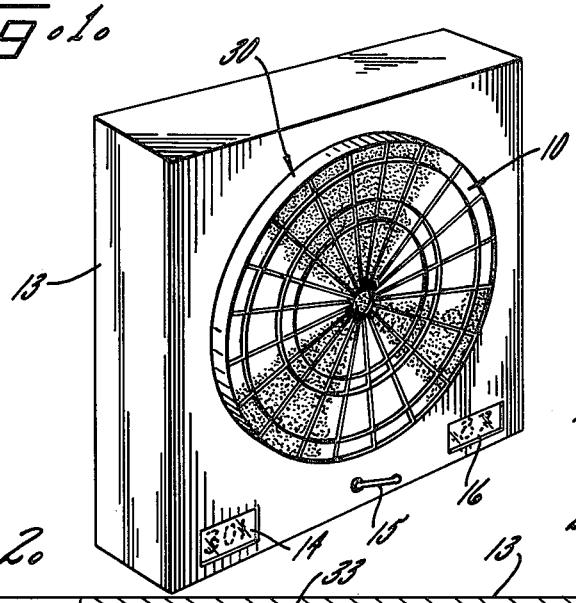
FIG. 1 is a perspective view of a new and improved dart board incorporating the unique features of the present invention.

As shown in the drawings for purposes of illustration, the invention is embodied in a dart game having a dart board 10 which forms a target for a dart 11 (FIG. 10) adapted to be thrown at the board. In this instance, the dart board is partially housed within and is partially located outside of a box-like cabinet 13 which contains electronic components enabling automatic registration and visual signaling of the score achieved by the players. Automatic scoring is not new per se and the specific components for registering, totaling and displaying the score do not form any part of the present invention so they need not be described herein. It will suffice to note that the score registered by one player may be visually displayed in a window 14 (FIG. 1) in the outer side of the cabinet and, when that player's turn is finished, a switch 15 may be flipped to cause a subsequent player's score to be displayed in a second window 16.

Figure 10:
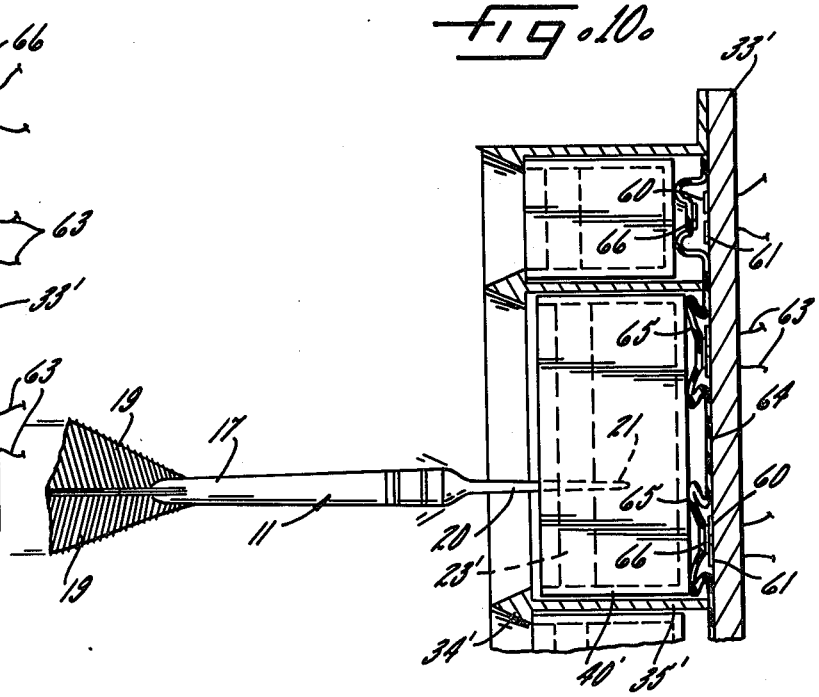
FIG. 10 is a view similar to FIG. 9 but shows parts in moved positions.

In one of its aspects, the present invention contemplates the provision of a dart game having unique darts 11 which have virtually the same appearance, "feel" and throwing characteristics as standard metal tipped darts but which are of the "safe" type in that it is virtually impossible for the darts to puncture a person's skin or to form pin holes in the cabinet 13 or an adjacent wall in the event the darts miss the board 10. One of the darts is shown in FIG. 10 and includes a conventionally shaped body 17 made of plastic or wood. Four angularly spaced tail fins 19 are located at the rear of the body and may be made of plastic and molded integrally with the body or may be in the form of feathers which are attached to the body.

Attached to and projecting forwardly from the body 17 is a long slender tip 20 which is virtually identical in size and shape to the standard metal tips with which most conventional darts are equipped. In carrying out the invention, however, the tip 20 is formed from flexible plastic such as Delrin and terminates in a point 21 which is blunt when compared with the extremely sharp points at the ends of metal tipped darts. The plastic tip 20 could have a square cross-section but preferably is of circular cross-section and tapers just slightly upon progressing outwardly to the point 21. The tip has a length of about 1¼ inches and a diameter on the order of 1/16 of an inch. A very gradual taper may be formed at the point 21 but, again, it must be emphasized that the point is not dangerously sharp. One may very firmly press one's thumb or finger against the point 21 and will not pierce the skin or experience a high level of pain.

Being made of flexible plastic, the tip 20 deflects when the dart 11 is thrown at and strikes a solid object. Because the tip deflects and has a blunt point 21, it tends to bounce off of the object rather than to penetrate the object. For example, the dart may be thrown at one's bare arm with full force and will simply bounce harmlessly away without leaving hardly any mark at the point of contact. If one is struck in the eye by the dart, some injury may occur but the injury will not be as severe as that caused by a sharp metal tipped dart.

Accordingly, the present dart 11 has virtually the same characteristics as the widely used metal tipped darts but is not nearly so dangerous. The dart may be used safely by small children and is especially suitable for use in taverns or the like where metal tipped darts sometimes are used as weapons. Moreover, the dart will not stick in and damage walls, paneling or the like which might be located behind the dart board 10.

Figure 6:
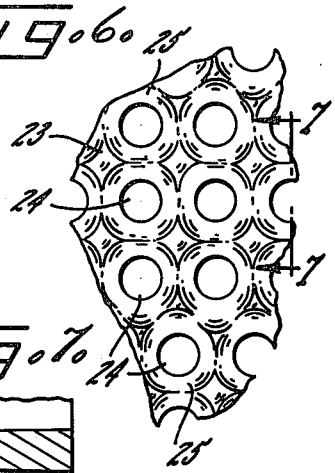
FIG. 6 is a front elevation, on a greatly enlarged scale, of part of one of the target plates.

Further in keeping with the invention, the dart board 10 is constructed in a unique manner so that the flexible tipped darts 11 may strike the board and will be retained thereon rather than bouncing off and falling to the floor. For this purpose, the board includes an array of target plates or wafers 23 which are formed with a large number of very closely spaced holes 24 (FIGS. 6 and 7) for receiving the tip 20 of the dart. When the dart is thrown at the board, the tip either telescopes directly into one of the holes 24 or else strikes a portion of the wafer 23 adjacent the hole and then is deflected into the hole. Because of the arrangement and construction of the holes, only rarely does a dart bounce from and fail to "stick" on the board. Thus, the present dart game provides the players with virtually the same effect as a conventional dart game in which a metal tipped dart pierces and sticks in a board made of cork or the like.

More specifically, each wafer 23 preferably is made of rigid plastic and has a thickness of approximately ¼ of an inch. The wafers are formed by well-known injection molding techniques and the holes 24 are formed in the wafers as an incident to the molding process. The holes extend completely through each wafer although certain molding processes may leave a very thin membrane of plastic covering the inner ends of the holes. Any such membrane will be punched out of the hole the first time a dart tip 20 enters the hole.

Figure 7:
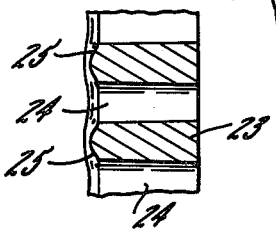
FIG. 7 is a fragmentary cross-section taken substantially along the line 7—7 of FIG. 6.

Each hole 24 preferably is of circular cross-section (see FIGS. 6 and 7) and has a size and shape corresponding substantially to the size and shape of the dart tip 20 although the hole could have a rectangular cross-section with a cross-sectional dimension corresponding substantially to the diameter of the cylindrical tip. As shown in FIG. 7, each hole tapers slightly upon progressing inwardly and thus a tip 20 may freely enter a hole but thereafter may tend to wedge in the hole. Even if the tolerances are such that wedging does not occur, the tip will almost always move through the hole sufficiently far to keep the dart from falling off of the board 10. Accordingly, the darts "stick" to and remain on the board even though the tips enter preformed holes 24 rather than piercing the board and forming their own holes. Because the wafers are not pierced, the board possesses a long service life when compared with boards which are pierced.

The center-to-center spacing between the different holes 24 ranges from about 3/32 of an inch to about 5/32 of an inch. In order to reduce the chances of the dart 11 bouncing from the board if the tip 20 strikes plastic between the holes, the outer end of each hole is enlarged somewhat and is formed with an inwardly tapered bevel as indicated at 25 in FIGS. 6 and 7 so as to lead the darts into the holes. As a result of the bevels, only narrow ribs are left between the holes, and any dart tip striking such a rib tends to slide off into a hole rather than bouncing away from the board 10. Accordingly, the holes effectively captivate the darts and it has been found that less than 5 percent of the darts which strike the wafers 23 fail to stick.

Figure 2:
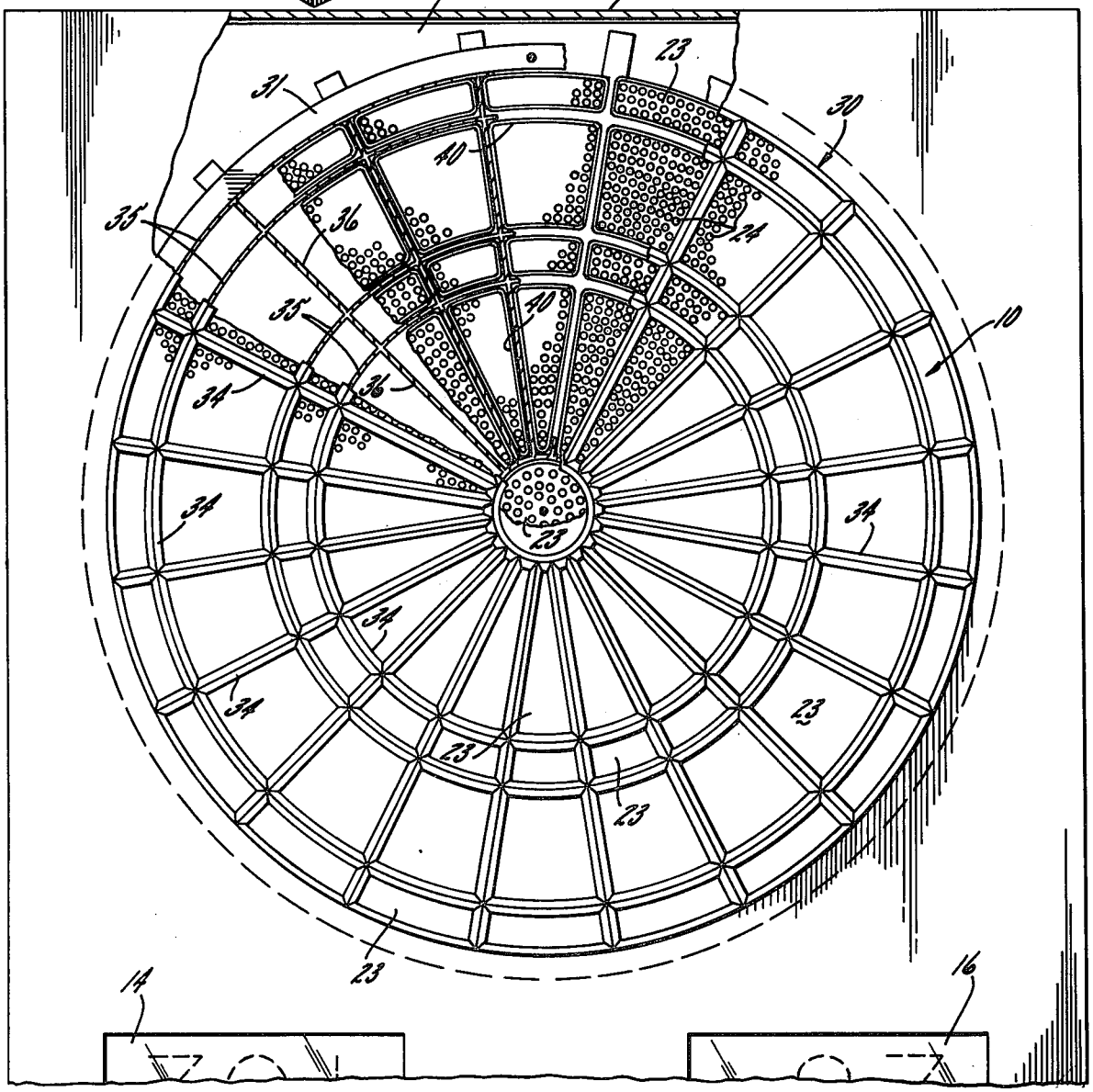
FIG. 2 is an enlarged front elevation of the board shown in FIG. 1 with parts of the board being broken away and shown in section.
Figure 3:
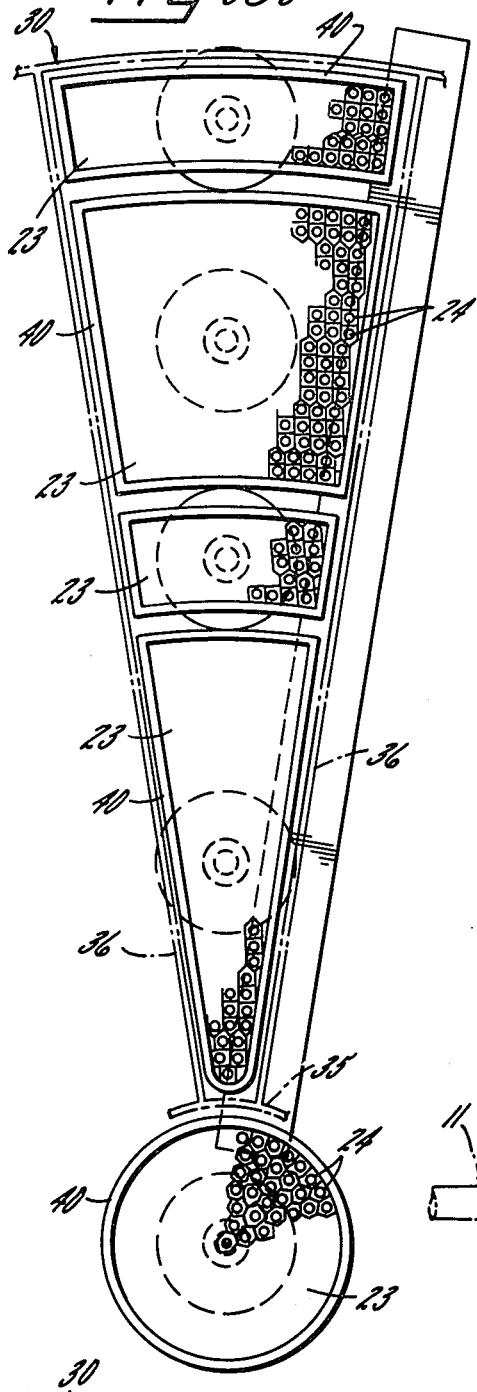
FIG. 3 is an enlarged front elevation of parts shown in FIG. 2.
Figure 4:
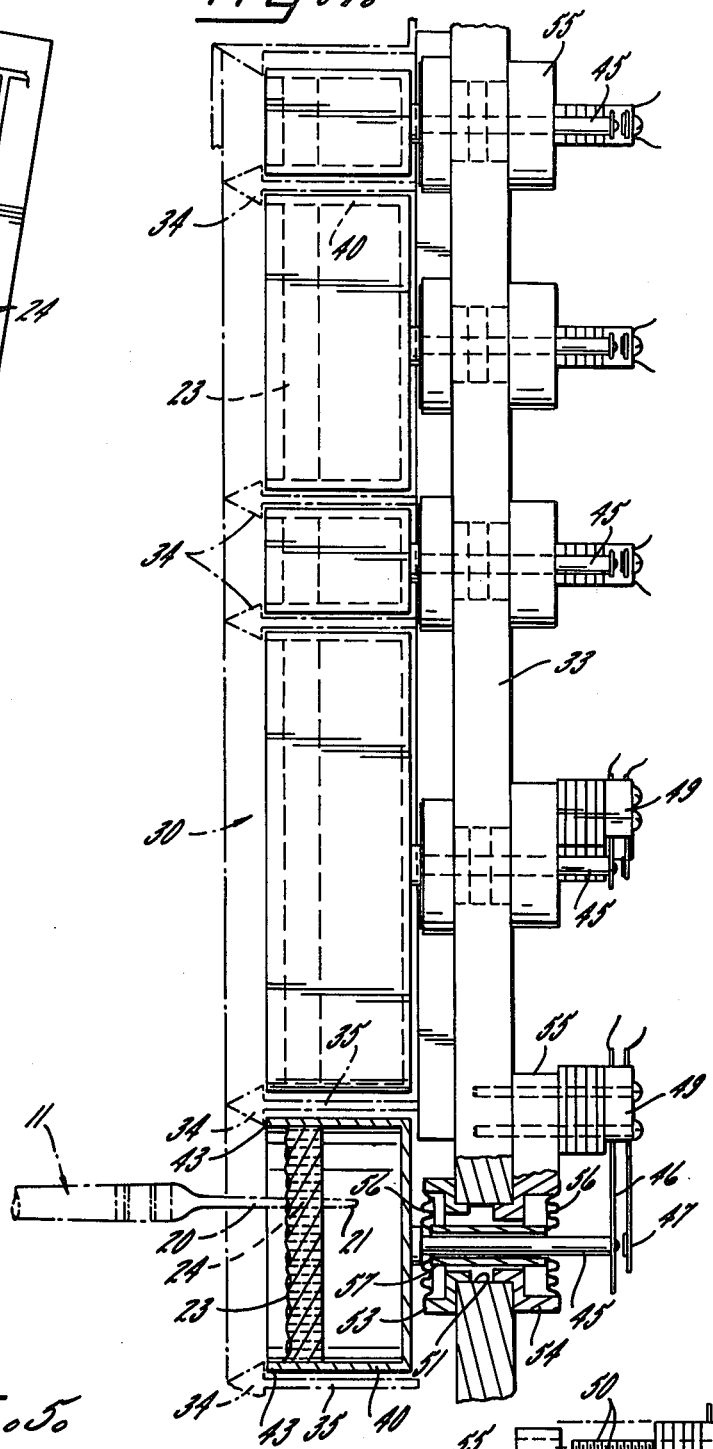
FIG. 4 is a side elevation of the parts shown in FIG. 3 with certain portions of the view being broken away and shown in section.
Figure 5:
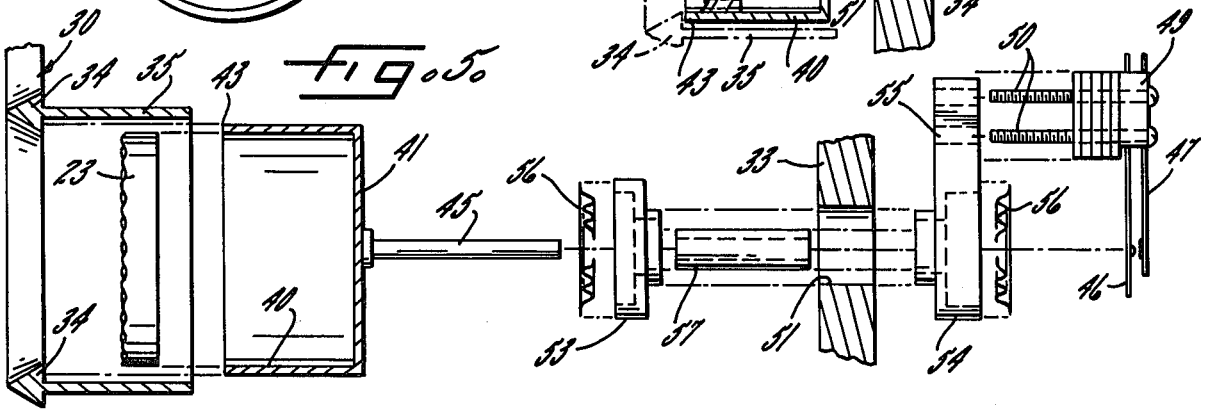
FIG. 5 is an exploded view of certain parts shown in FIG. 4.

In the present instance, the board 10 includes 81 wafers 23 arranged in a circle and disposed in edge-to-edge relation so as to define different scoring areas having different score values. There are four circumferentially extending and radially spaced rows of wafers with each row containing 20 wafers and with the wafers of the different rows being of different trapezoidal shapes as shown in FIG. 2. In the center of the board is a single circular wafer which defines a bullseye. To help define the different scoring areas, the board includes a plastic spider 30 having a circular rim 31 (FIG. 2) encircling the outer row of wafers and attached to a main support of plate 33 (FIG. 4) which is located inwardly of the wafers. The spider further includes a series of circumferentially and radially extending ribs 34 located in front of the wafers and extending along the margins of the wafers, there being one rib disposed between adjacent margins of adjacent wafers. Each rib is of substantially triangular cross-section and includes equilateral sides which slope inwardly from an outer apex as shown in FIG. 5. As a result, a dart which strikes a rib 34 tends to slide inwardly along one of the sloped sides and finds its way into one of the holes 24 instead of merely bouncing off of the rib.

Extending inwardly from and centered relative to each of the circumferential ribs 34 is an annular wall 35 (FIGS. 2 and 5) whose inner edge abuts the main support plate 33. Also, webs 36 (FIG. 2) are centered relative to and extend inwardly from the radial ribs 34 and are integral with the walls 35, the webs terminating well short of the support plate 33. The walls 35 and webs 36 are molded integrally with the ribs 34, are considerably narrower than the ribs, and serve to stiffen and reinforce the ribs.

In accordance with another important aspect of the invention, the several target wafers 23 are supported for independent inward movement and, when a given wafer is struck by a dart 11, that wafer moves inwardly and causes an electrical signal to be produced. Such signal may be transmitted to and utilized by a scoring register to indicate the score obtained by the player throwing the dart.

Herein, each target wafer 23 is supported for movement with a plastic cup 40 (FIG. 5) whose peripheral shape corresponds to the peripheral shape of the particular wafer. Each cup includes a closed inner end 41 and an open outer end, the extreme outer end of the cup being defined by a lip 43. The wafers 23 are telescoped into the open ends of the cups 40 and are cemented rigidly to the cups. Each cup has a depth of approximately ⅞ of an inch and, in carrying out the invention, each wafer is located in its cup such that the outer face of the wafer is spaced inwardly a short distance (e.g., 5/32 of an inch) from the outer lip 43 of the cup as shown in FIG. 4.

The cups 40 are located between the ribs 34 and the main support plate 33 with each cup being disposed within the space bounded by the walls 35 and webs 36 of a particular scoring area. In the embodiment of FIGS. 1 to 5, each cup is spaced a substantial distance from and does not contact the adjacent walls 35 and webs 36 but the outer lip 43 of the cup does engage the inner sides of the ribs 34 as shown in FIG. 4. As a result of such engagement together with the inward spacing of the wafer 23 from the lip 43, the outer face of each wafer is held in inwardly spaced relation from the inner sides of the ribs 34 so that the holes 24 adjacent the extreme peripheral edges of the wafer are not shielded by the ribs but instead are fully exposed and thus can accept the dart tip 20 if the tip should happen to strike near one of the peripheral edges. This further reduces the likelihood of the dart 11 failing to stick on the board 10.

In the embodiment shown in FIGS. 1 to 5, an inwardly extending cylindrical rod 45 (FIGS. 4 and 5) is molded integrally with the closed end 41 of each cup 40 and, when the cup is pushed inwardly by a dart 11, the rod closes the normally open contacts 46 and 47 of a switch 49 for producing the electrical scoring signal. The switch 49 is a conventional microswitch and is attached to the inner side of the support plate 33 by screws 50. The contacts 46 and 47 are of the leaf spring type and normally are spaced from one another with the contact 46 being disposed in engagement with the inner end of the rod 45. When a dart hits the wafer 23 and the rod is shifted inwardly, it pushes the contact 46 into momentary engagement with the contact 47 to cause current to flow between the terminals of the switch 49. The resilient contact 46 then snaps the rod 45 back outwardly and presses the lip 43 of the cup 40 against the inner sides of the ribs 34.

Advantageously, the cups 40 and the rods 45 are supported such that each rod may shift inwardly and deflect the switch contact 46 even though the dart 11 strikes one of the remote edges or corners of the wafer 23 and tends to cock the rod. To this end, each rod is supported so as to be capable of limited tilting and may shift inwardly without binding even if the rod is in a slightly cocked position. As shown in FIG. 4, each rod 45 extends through and is centered within a hole 51 extending through the support plate 33. An outer ring 53 is telescoped into and cemented in the outer end of the hole 51 while an inner ring 54 is cemented in the inner end of the hole and is formed with an extension 55 which serves as a mounting block for the switch 49. Resiliently flexible gauze-like diaphragms 56 are stretched over and cemented to the outer side of the outer ring 53 and the inner side of the inner ring 54 and each is formed with a central opening which receives the rod 45, the latter being cemented to the diaphragms. Telescoped loosely over the rod and into the rings is a sleeve 57 whose ends abut the inboard faces of the diaphragms.

By virtue of the flexible diaphragms 56, each cup 40 is supported for in and out movement and yet the rod 45 is not restricted to movement in a straight line. In other words, the rod can move inwardly while in a slightly tilted position, which the rod would assume if the force applied by the dart 11 should happen to be located a considerable distance from the axis of the rod. The rod thus can shift inwardly and close the switch contacts 46 and 47 regardless of where the dart hits. Also, the resilient diaphragms 56 help urge the cup 40 back outwardly after the cup has been shifted inwardly by the dart 11. When the player pulls the dart out of one of the holes 24, the engagement of the rim 43 of the cup 40 with the ribs 34 prevents the cup from being pulled forwardly and damaging the diaphragms.

From the foregoing, it will be apparent that a dart 11 impacting a particular scoring area will cause the wafer 23, the cup 40 and the rod 45 to momentarily shift inwardly so that the rod may close the switch contacts 46 and 47 and effect registering of the score. Inward shifting of the rod by the dart may be effected in a number of ways. That is, the tip 20 may wedge in one of the holes 24 and the force of such wedging will shift the rod inwardly. If the tip does not wedge, it will proceed through the hole and strike the closed end 41 of the cup 40 to effect inward shifting of the rod. Even if the dart should happen to bounce off of the wafer, the force of the impact usually will be sufficient to shift the rod inwardly and thus the proper score still will be registered.

Figure 8:
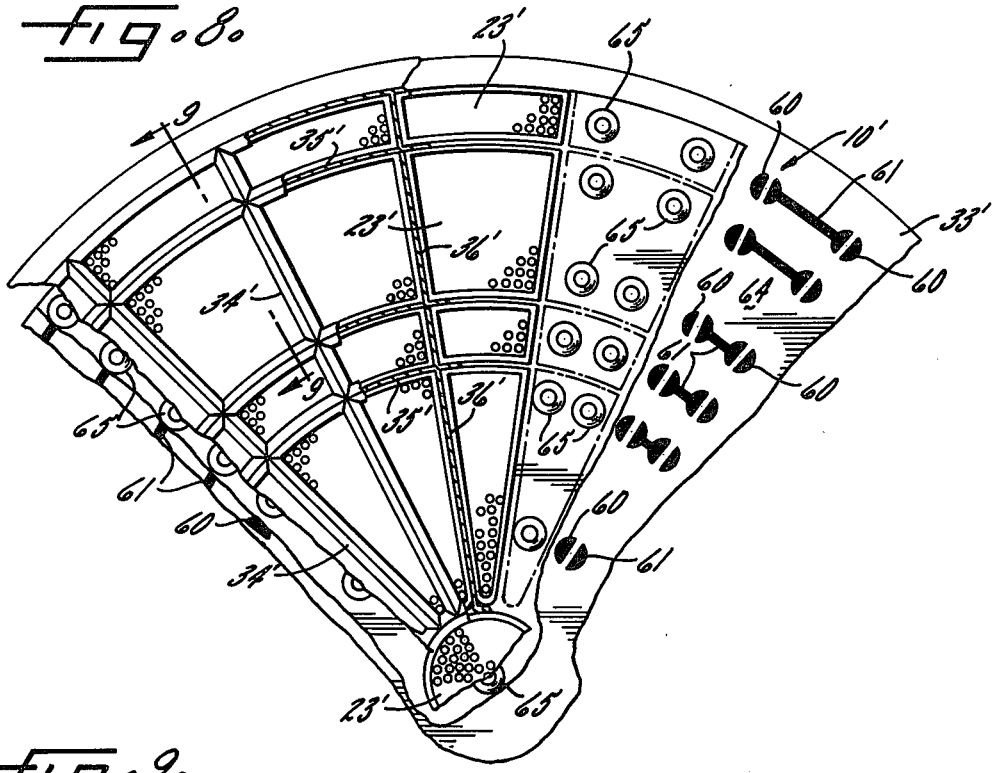
FIG. 8 is a fragmentary view similar to FIG. 2 but shows a modified board incorporating the features of the invention.
Figure 9:
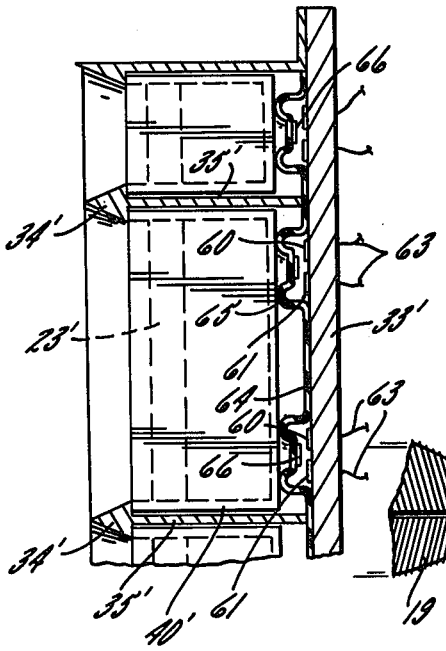
FIG. 9 is an enlarged fragmentary cross-section taken substantially along the line 9—9 of FIG. 8.

Another embodiment of a dart board 10' which incorporates the features of the invention is shown in FIGS. 8 to 10 in which parts corresponding to those of the first embodiment are indicated by the same but primed reference numerals. The board 10' is simpler in construction than the board 10 and is less expensive to manufacture.

Specifically, the board 10' does not require microswitches but instead employs printed circuit contacts 60 and 61 (FIG. 8) to produce the electrical signals for automatic scoring. As shown in FIG. 8, these contacts are in the form of conductive metal strips which are printed on the outer face of a plastic support plate 33' in proximity to the different scoring areas, there being several sets of contacts for each scoring area. In one specific example, the contact 61 may be an elongated strip which is located between and spaced from two semi-circular dots defining the contacts 60. Alternatively, the contacts 60 and 61 both may take the form of semi-circular dots as illustrated by the lower set of contacts in FIG. 8. Regardless of their specific shape, the contact 60 of each set resides at one voltage level while the contact 61 resides at a different voltage level so that, when the contacts are bridged by a conductor, current may flow between the contacts via lead wires 63 (FIG. 9) connected to the contacts and a voltage source (not shown).

In order to effect bridging of the contacts 60 and 61 of a given set of contacts when a dart 11 strikes a particular wafer 23', a resilient sheet 64 (FIGS. 9 and 10) made of rubber or plastic is attached to virtually the entire outer side of the support plate 33'. The sheet is formed with several bellows-like buttons 65 each having a circular cross-section. Each button is located just outwardly of the contacts 60 and 61 and carries a contact or conductor 66 which normally is spaced outwardly of but in overlapping relation with the contacts as shown in FIG. 9. The outer sides of the buttons are disposed in abutting engagement with the closed ends of the cups 40'.

When one of the cups 40' is shifted inwardly by the dart 11, at least one of the buttons 65 is deflected inwardly as shown in FIG. 10 and momentarily moves its conductor 66 into bridging relation with the contacts 60 and 61 to produce a scoring signal. The compressed button then flexes outwardly to shift the cup 40' outwardly until its rim engages the inner sides of the ribs 34'. In the embodiment shown in FIGS. 8 to 10, the cups are not supported by rods but instead lightly engage the walls 35' and the webs 36'. There is sufficient clearance around the outer side of each cup to allow the cup to cock slightly and deflect one or more of the buttons 65 if the dart should happen to strike one of the remote corners or edges of the wafers 23'. In other words, the walls 35' and webs 36' do not confine the cups 40' to perfect straight line movement but instead allow the cups to tilt slightly as the cups are shifted inwardly by the darts.

We claim:

1. A dart game comprising the combination of (a) a dart having a slender tip and (b) a dart board which forms a target for said dart, said dart board comprising an array of target plates each having a number of closely spaced holes molded in the outer face thereof, each of said holes having a cross-sectional dimension corresponding substantially to the cross-sectional dimension of said tip whereby said tip may enter into and will remain in one of said holes when said dart is thrown at said board, a main support located inwardly of said target plates, cups telescopically receiving said target plates and slidable inwardly and outwardly relative to said support, means biasing said cups outwardly relative to said support, each of said cups having an open outer end and a closed inner end, each target plate being spaced inwardly from the open end of its respective cup, ribs located outwardly of said target plates and extending around the margins of said plates, there being one rib between adjacent margins of adjacent plates, the open ends of said cups being engageable with the inner sides of said ribs to keep the outer faces of said target plates spaced inwardly from the inner sides of said ribs.

2. A dart game as defined in claim 1 in which the outer end portions of said holes are defined by inwardly tapered bevels.

3. A dart game as defined in claim 1 in which said tip is substantially cylindrical, each of said holes having a substantially cylindrical inner end portion whose diameter corresponds substantially to the diameter of said tip, and each of said holes having an inwardly tapered outer end portion whose largest cross-sectional dimension is larger than the diameter of the inner end portion of said hole.

4. A dart game as defined in claim 1 including a first electrical contact associated with each cup and positioned to be moved inwardly when said cup is slid inwardly relative to said support, and a second electrical contact associated with each first contact and located on said support to be engaged by said first contact when the latter is moved inwardly.

5. A dart game as defined in claim 4 further including a rod projecting inwardly from the closed end of each cup, means on said support and guiding each rod for in and out sliding while permitting said rod to tilt, said first contact being located in engagement with the inner end of said rod.

6. A dart game as defined in claim 1 including a first electrical contact associated with each cup and positioned to be moved inwardly when said cup is slid inwardly relative to said support, and two spaced electrical contacts associated with each first contact and located on said support to be bridged by said first contact when the latter is moved inwardly.

7. A dart game as defined in claim 6 in which each of said two spaced electrical contacts is printed on said support with one of such contacts residing at a different voltage level than the other of such contacts so that current is conducted between said two spaced contacts when the latter are bridged by said first contact.

8. A dart game as defined in claim 6 in which said biasing means comprise resiliently yieldable means disposed between said support and the closed end of each cup and urging the latter outwardly, each of said first contacts being supported on said resiliently yieldable means, said resiliently yieldable means deflecting inwardly and moving said first contacts inwardly when said cups are slid inwardly.

9. A dart game as defined in claim 8 in which a resiliently yieldable sheet is attached to the outer side of said support, said resiliently yieldable means comprising a series of bellows-like buttons formed integrally with and projecting outwardly from said sheet.

10. A dart game as defined in claim 1 in which the tip of said dart is made of flexible plastic and terminates in a comparatively blunt point.

* * * * *